United States Patent [19]

Stadler et al.

[11] Patent Number: 4,615,578

[45] Date of Patent: Oct. 7, 1986

[54] MASS TERMINATION DEVICE AND CONNECTION ASSEMBLY

[75] Inventors: Edwin B. Stadler, Livermore; Lajos J. Vidakovits, Mountain View, both of Calif.

[73] Assignee: Raychem Corporation, Menlo Park, Calif.

[21] Appl. No.: 678,924

[22] Filed: Dec. 5, 1984

[51] Int. Cl.[4] ..... H01R 4/66

[52] U.S. Cl. ..... 339/143 R

[58] Field of Search ..... 339/143 R, DIG. 1, 138, 339/141, 14 R

[56] References Cited

U.S. PATENT DOCUMENTS

| | | | |
|---|---|---|---|
| 3,086,242 | 7/1960 | Cook et al. | 18/1 |
| 3,297,819 | 8/1964 | Wetmore | 174/127 |
| 3,721,749 | 3/1973 | Clabburn | 174/DIG. 8 |
| 3,761,844 | 9/1973 | Reeder | 339/143 R |
| 3,993,394 | 11/1976 | Cooper | 339/136 M |
| 4,236,779 | 12/1980 | Tang | 339/143 R |
| 4,272,148 | 6/1981 | Knack, Jr. | 339/143 R |
| 4,337,989 | 7/1982 | Asick et al. | 339/143 R |
| 4,376,798 | 3/1983 | Diaz | 174/DIG. 8 |
| 4,382,653 | 5/1983 | Blanchard | 339/143 R |
| 4,467,002 | 8/1984 | Crofts | 428/36 |
| 4,537,458 | 8/1985 | Worth | 339/143 R |
| 4,557,545 | 12/1985 | Ohtsuki et al. | 339/143 R |

FOREIGN PATENT DOCUMENTS

| | | | |
|---|---|---|---|
| 2316053 | 10/1973 | Fed. Rep. of Germany | 339/DIG 1 |
| 2910906 | 3/1979 | Fed. Rep. of Germany . | |

OTHER PUBLICATIONS

Chomerics, Inc., ad in Insulation Magazine, p. 23, Aug. 1969.

*Primary Examiner*—Gil Weidenfeld
*Assistant Examiner*—Gary F. Paumen
*Attorney, Agent, or Firm*—Ira David Blecker; James W. Peterson

[57] ABSTRACT

A mass termination device for terminating a plurality of shielded cables to a connector, the device insuring continuity of the electromagnetic shielding into the connector. The device utilizes a pair of complementary busbar-type grounding members, each having a connector shell contact portion and having a plurality of laterally extending complementary mating semicircular elements, the elements to be clamped onto the shielding braids of cables to be connected so as to substantially surround each individual shielding braid. The device preferably further includes apertures in the semicircular elements of at least one of the busbar-type grounding members. Fusible material is juxtapositioned with respect to the apertures and individual heat-recoverable tubes surround the fusible material and the mating pairs of semicircular elements. A heat-recoverable boot surrounds the pair of busbar-type grounding members, the tubes and the fusible inserts. The grounding members are clamped about cables and the connector shell. Upon application of heat, the heat-recoverable boot and the tubes will recover to encapsulate the pair of busbar-type grounding members and the fusible material will melt and fuse the busbar-type grounding members to the shielding braids of cables positioned therebetween.

16 Claims, 3 Drawing Figures

MASS TERMINATION DEVICE AND CONNECTION ASSEMBLY

BACKGROUND OF THE INVENTION

1. Field of The Invention

The invention relates generally to electromagnetic compatible (EMC) shielded and grounded electrical cables and connectors, and more particularly to a system for terminating a plurality of shielded cables to a connector. Specifically, the present invention relates to a device for terminating a plurality of electrical cable shields and for maintaining the integrity of the EMC shielding of an entire connector assembly.

2. Description of Related Art

EMC shielded cables and connection assemblies are frequently used for the transmission of data signals between programmable instruments, such as computers and the like, as well as in other environments wherein electrical and electromagnetic radiation can be expected to interfere with the electrical signals carried by the interconnecting cables and connector assemblies.

U.S. Pat. No. 4,236,779 to Tang illustrates a shielded connection assembly or grounding structure which extends the shielding into and through a connector housing. Likewise, German patent publication No. 29 10 906 assigned to Siemens discloses shielded, multiconductor connectors having two-piece or multiple-piece grounding structures. Specifically the Siemens application discloses a pair of grounding plates 14 within the connector housing. Existing techniques such as these are unfortunately not very effective. Such devices fail to blanket the termination area and fail to provide total continuous coverage.

The instant device provides a pair of complementary busbar-type grounding members, each having a connector shell contact portion and a plurality of laterally extending complementary mating semicircular elements that may be clamped to substantially surround and therefore provide continuous coverage to a plurality of shielding braids. The busbar-type grounding members may in turn be secured to the connector shell to continue the shield for the entire connection assembly or system.

SUMMARY OF THE INVENTION

The purpose of the instant invention is to provide total, continuous EMC protection for the shielding of primary wires, terminations and terminations to a connector wafer, i.e. to ensure continuity of electromagnetic shielding for a connection assembly. To accomplish this purpose, a mass termination device is provided having a pair of complementary busbar-type grounding members, each having a connector shell contact portion and a plurality of laterally extending complementary mating semicircular elements to be clamped about and onto the shielding braids of cables.

Accordingly, in one aspect the invention provides a mass termination device comprising a pair of complementary busbar-type grounding members, each member having a connector shell contact portion and having a plurality of laterally extending complementary mating semicircular elements, said pair of members and their respective semicircular elements defining a plurality of openings therebetween, said elements capable of being clamped onto the shielding braids of cables to be connected to insure continuity of the electromagnetic shielding of the device.

In another aspect, the invention comprises a connection assembly comprising:

a connector wafer having a plurality of center conductor contacts;

a conductive connector shell surrounding a portion of the connector wafer;

a plurality of shielded cables each having at least one center conductor and a shielding braid, the center conductors connected to the respective center conductor contacts;

a mass termination device comprising a pair of complementary busbar-type grounding members, each pair having a connector shell contact portion connected to said connector shell, each member having a plurality of laterally extending semicircular elements defining a plurality of openings therebetween, the shielding braid of the respective shielded cables positioned within said openings, the elements being clamped onto the shielding braids to ensure continuity of electromagnetic shielding.

DESCRIPTION OF THE PREFERRED EMBODIMENT

Figure 1:
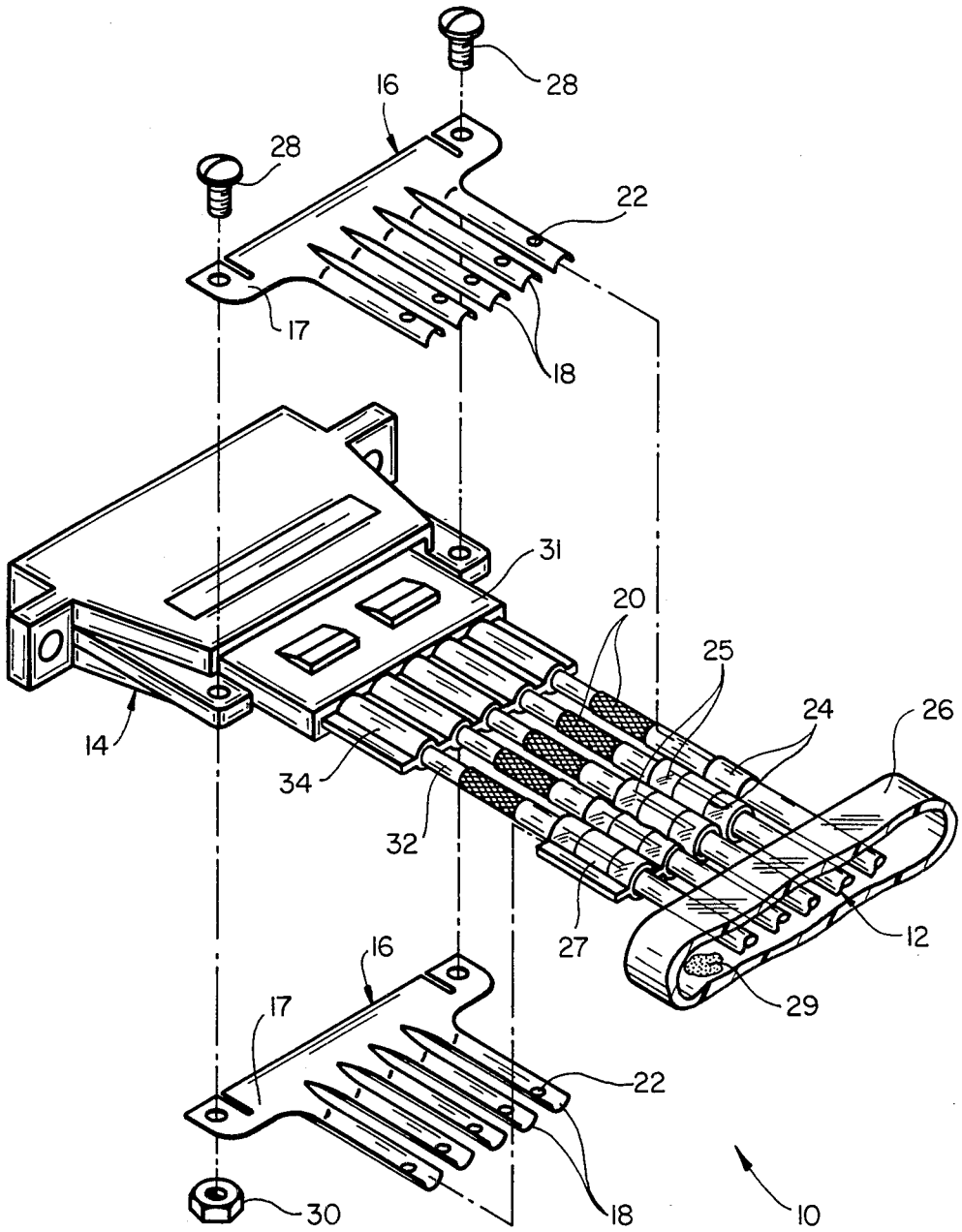
FIG. 1 is a perspective exploded view of a connection assembly utilizing the mass termination device of the instant invention.

With continued reference to the drawing, FIG. 1 illustrates a mass termination device shown generally at 10 for terminating a plurality of shielded cables shown generally at 12 to an electrically conductive connector shell shown generally at 14. The shielded cable may be a coaxial cable, a shielded twisted pair cable or other shielded construction. The mass termination device 10 basically comprises a pair of busbar-type grounding members 16, each having a connector shell contact portion shown generally at 17 and a plurality of laterally extending complementary mating semicircular elements 18 to be clamped onto the shielding braids (or the like) 20 of the individual cables shown generally at 12. In its broadest concept, the mass termination device comprises this pair of busbar-type grounding members 16 alone. The long semicircular portions also substantially surround the primary wire(s) for EMC integrity. The device further includes individual apertures 22, one in each of the plurality of laterally extending semicircular elements 18, as well as fusible material in the form of a plurality of complementary fusible members 24 which are complementary to the pair of semicircular elements 18, the fusible material juxtapositioned with respect to apertures 22. Also included in the preferred device is a heat-recoverable boot 26 which may be heat-recovered over the grounding members 16 and a portion of the connector shell 14, as will be discussed further.

Also illustrated in FIG. 1 is the use of a plurality of heat-recoverable tubes 25, each individual fusible member 24 surrounded by a respective heat-recoverable tube 25. This is an alternative construction. These tubes 25 are preferably somewhat transparent so that the fusing of the solder within may be checked visually.

In addition, FIG. 1 illustrates the use of a bandoleer-like connection means 27 which is heat-recoverable and which contains fusible material therein as will be discussed later.

The pair of busbar-type grounding members 16 may be clamped about the shielding braids 20 wherein the individual semicircular elements of each grounding member 16 substantially surround each individual shielding braid 20. This can be more clearly seen in FIG. 2 wherein the heat-recoverable boot 26 is shown to be transparent, and wherein the grounding members 16 have been clamped (and preferably soldered) about shielding braids and have been clamped at connector shell portions 17 to the connector shell 14.

Connector shell 14 is a part of a unique shielded electrical connector plug or socket which is used to mate with a complementary connector assembly or piece of equipment having such a counterpart connector. Such a connector assembly is disclosed in commonly-assigned U.S. Pat. No. 3,993,394 which is incorporated by reference herein. As mentioned earlier, the pair of busbar-type grounding members 16 are clamped at their respective connector shell contact portions 17 to the connector shell 14 by mechanical means such as machine screws 28 and complementary nuts 30. It is understood that the location and configuration of the contact portions 17 may vary depending upon the particular connector shell and connection assembly. In addition, a plurality of center conductor contacts run laterally through the body of connector wafer 31 and are each individually connected to the primary conductors 32 of the shielded twisted pair, coaxial, etc., cables 12 by individual Solder Sleeve devices well known in the art or by bandoleer-like connection means 34 as seen in FIG. 1. Such a bandoleer-like connection means is disclosed in commonly-assigned U.S. Pat. Nos. 3,721,749 and 4,376,798 which are incorporated herein by reference. These bandoleer-like connection means 34 and as mentioned earlier 27 comprise an open-ended hollow heat-recoverable member having a train of longitudinal seams disposed across the width thereof integrally bonding the opposed walls thereof to one another to define and integrally connect a plurality of spaced tubular members sized to receive conductors therein. Solder inserts are positioned within the tubular members so that upon heat-recovery the solder fuses. It is understood that such bandoller-like connection means 34 and 27 allow the semicircular elements to substantially surround the individual shielding braids and also the primary conductor(s) connections.

Mass termination device 10 preferably includes apertures 22, tubes 25 and complementary fusible members 24 and heat-recoverable boot 26 as discussed earlier. It is understood that it is within the scope of the invention to provide apertures in only one of the busbar-type grounding members 16, provided the apertures are sufficient for the fusible material of the members 24 to flow and to fuse the respective pair of grounding members 16 to shielding braids 20 of the cables 12. The fusible material in this instance is solder in the form of rings which are positioned over the semicircular elements and the apertures 22 prior to elevation in temperature.

Figure 2:
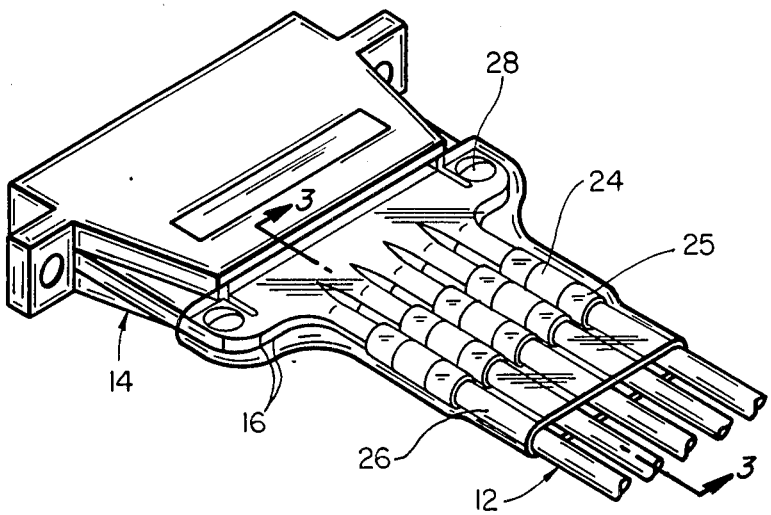
FIG. 2 is a perspective view of the connection assembly wherein the mass termination device has been heat-recovered onto the plurality of shielding braids and wherein the pair of busbar-type grounding members have been electrically interconnected with the connector shell.
Figure 3:
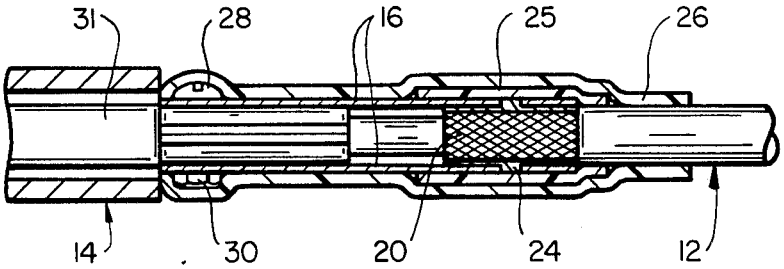
FIG. 3 is a cross-sectional view taken along section lines 3—3 in FIG. 2.

FIG. 2 illustrates the mass termination device of the instant invention after installation. Heat-recoverable boot 26 and tubes 25 are shown to be transparent to illustrate the operation of the device. In practice, it may be desirable to have boot 26 somewhat transparent so that the various fused connections may be inspected after heating of the device. In FIGS. 2 and 3 it can be seen that the fusible member 24 has melted and fused grounding members 16 and shielding braids 20. It can also be seen that boot 26 has recovered down onto the assembly to encapsulate the assembly and to additionally provide some strain relief with respect to the assembly.

Fusible member 24 preferably comprises a solder. However, it is within the scope of the invention to use any fusible material which will electrically and preferably but not necessary mechanically connect grounding members 16 and shielding braids 20. In the case of solder, the quantity of solder may, if desired or required, have an appropriate amount of flux associated therewith.

Heat-recoverable boot 26 and the tubes 25 used in accordance with this invention are such that at least part of each will shrink upon application of heat, and may comprise any material, advantageously an insulating material, which may be converted to or maintained in heat-shrinkable form. Examples of suitable materials are given in, for example, U.S. Pat. Nos. 3,086,242 and 3,297,819, and in other patents referred to in the specification. Cross-linked polymeric materials, for example but not limited to cross-linked polyvinylidene fluoride, are particularly suitable. In addition, the boot may comprise two or more layers and the inner layer(s) need not comprise the same material as the outer layer.

The heat-recoverable boot 26 may further include an electrically conductive layer shown generally at 29 in FIG. 1 (and not shown in the other Figures). Commonly-assigned U.S. Pat. No. 4,467,002, which is incorporated herein by reference, teaches the use of such an electrically conductive layer to provide controlled EMC and electrical insulation.

While embodiments and applications of this invention have been shown and described, it will be apparent to those skilled in the art that many more modifications are possible without departing from the inventive concepts herein described, and that all such embodiments which come within the meaning and range of equivalency of the claims thereof are intended to be embraced therein.

What is claimed is:

1. A mass termination device comprising a pair of complementary busbar-type grounding members, each member having a connector shell contact portion and having a plurality of laterally extending complementary mating semicircular elements each of which directly contacts an opposed one of said elements, said pair of members and their respective semicircular elements defining a plurality of openings therebetween, said elements capable of being clamped onto the shielding braids of cables to be connected to ensure continuity of the electromagnetic shielding of the device.

2. The device of claim 1 wherein the semicircular elements of at least one of the grounding members are each provided with an aperture through the semicircular elements.

3. The device of claim 2 further including fusible material juxtapositioned with respect to said apertures and further including a heat-recoverable boot surrounding said grounding members and said fusible material.

4. The device of claim 3 wherein the fusible material is in the form of individual fusible members, each member surrounding a pair of said semicircular elements.

5. The device of claim 4 further including a plurality of individual heat-recoverable tubes, each individual fusible member being surrounded by a respective heat-recoverable tube, the heat-recoverable boot surrounding the grounding members, the fusible members and the heat-recoverable tubes.

6. The device of claim 4 further including a bandoleer-like connection means comprising an open-ended hollow heat-recoverable member having a plurality of tubular portions that are heat-recoverable, one fusible member and a respective pair of elements being positioned within each tubular portion, the heat-recoverable boot surrounding the grounding members, the fusible members and the heat-recoverable member.

7. The device of claim 3 wherein the heat-recoverable boot includes an inside surface at least a part of which has an electrically conductive layer adhering thereto to provide controlled EMC and electrical insulation.

8. The device of claim 6 wherein the heat-recoverable boot includes an inside surface at least a part of which has an electrically conductive layer adhering thereto to provide controlled EMC and electrical insulation.

9. A connection assembly comprising:

a connector wafer having a plurality of center conductor contacts;

a conductive connector shell surrounding a portion of the connector wafer;

a plurality of shielded cables each having at least one center conductor and a shielding braid, the center conductors connected to the respective center conductor contacts;

a mass termination device comprising a pair of complementary busbar-type grounding members, each member having a connector shell contact portion connected to said connector shell, each member having a plurality of laterally extending complementary mating semicircular elements, each of which directly contacts an opposed one of said elements, said elements defining a plurality of openings therebetween, the shielding braid of the respective shielded cables positioned within said openings, the elements being clamped onto the shielding braids to ensure continuity of electromagnetic shielding.

10. The assembly of claim 9 wherein the semicircular elements of at least one of the grounding members are each provided with an aperture through the semicircular elements.

11. The assembly of claim 10 further including fusible material fused through said apertures to connect the grounding members and the shielding braids.

12. The assembly of claim 11 further including a heat-recovered boot surrounding the grounding members.

13. A connection assembly comprising:

a connector wafer having a plurality of center conductor contacts;

a conductive connector shell surrounding a portion of the connector wafer;

a plurality of shielded cables each having at least one center conductor and a shielding braid, the center conductors connected to the respective center conductor contacts;

a mass termination device comprising a pair of complementary busbar-type grounding members, each member having a connector shell contact portion connected to said connector shell, each member having a plurality of laterally extending complementary mating semicircular elements, each of which directly contacts an opposed one of said elements, said elements defining a plurality of openings therebetween wherein the semicircular elements of at least one of the grounding members are each provided with an aperture through the semicircular elements, the shielding braid of the respective shielded cables positioned within said openings, the elements being clamped onto the shielding braids to ensure continuity of electromagnetic shielding:

fusible material fused through said apertures to connect the grounding members and the shielding braids;

a heat-recovered boot surrounding the grounding members; and further including a plurality of individual heat-recovered tubes, one tube per each pair of complementary elements, the heat-recovered boot surrounding the tubes and grounding members.

14. A connection assembly comprising:

a connector wafer having a plurality of center conductor contacts;

a conductive connector shell surrounding a portion of the connector wafer;

a plurality of shielded cables each having at least one center conductor and a shielding braid, the center conductors connected to the respective center conductor contacts;

a mass termination device comprising a pair of complementary busbar-type grounding members, each member having a connector shell contact portion connected to said connector shell, each member having a plurality of laterally extending complementary mating semicircular elements, each of which directly contacts an opposed one of said elements, said elements defining a plurality of openings therebetween wherein the semicircular elements of at least one of the grounding members are each provided with an aperture through the semicircular elements, the shielding braid of the respective shielded cables positioned within said openings, the elements being clamped onto the shielding braids to ensure continuity of electromagnetic shielding;

fusible material fused through said apertures to connect the grounding members and the shielding braids;

a heat-recovered boot surrounding the grounding members; and further including a bandoleer-like connection means comprising an open-ended hollow heat-recovered member having a plurality of tubular portions that are heat-recovered, one heat-recovered portion per each pair of complementary elements, the heat-recovered boot surrounding the bandoleer-like connection means and the grounding members.

15. The assembly of claim 13 wherein the heat-recoverable boot includes an inside surface at least a part of which has an electrically conductive layer adhering thereto to provide controlled EMC and electrical insulation.

16. The assembly of claim 14 wherein the heat-recoverable boot includes an inside surface at least a part of which has an electrically conductive layer adhering thereto to provide controlled EMC and electrical insulation.

* * * * *